US005458245A

United States Patent [19]

Heckel et al.

[11] Patent Number: 5,458,245

[45] Date of Patent: Oct. 17, 1995

[54] DEVICE FOR CLEANING A MIXTURE OF SUBSTANTIALLY GRANULAR GRAINS AND METHOD FOR CLEANING THIS MIXTURE OF GRAINS

[75] Inventors: Hans Heckel, Cremlingen; Dieter Müller, Sickte; Uwe Schwanke; Volhard Sorgatz, both of Braunschweig, all of Germany

[73] Assignee: Bühler GmbH, Braunschweig, Germany

[21] Appl. No.: 140,300

[22] Filed: Oct. 20, 1993

[30] Foreign Application Priority Data

Feb. 2, 1993 [DE] Germany ..... 43 02 857.8
Oct. 20, 1993 [DE] Germany ..... 42 35 260.6

[51] Int. Cl.[6] ..... B07B 4/00; B07B 7/00

[52] U.S. Cl. ..... 209/139.1; 209/143; 209/146; 209/149

[58] Field of Search ..... 209/133, 138, 209/139.1, 140, 141, 142, 143, 146, 147, 149

[56] References Cited

U.S. PATENT DOCUMENTS

| | | | |
|---|---|---|---|
| 492,720 | 2/1893 | Frey | 209/139.1 X |
| 2,645,345 | 7/1953 | Dodds | 209/146 X |
| 2,866,547 | 12/1958 | Gladfelter et al. | 209/135 X |
| 2,913,109 | 11/1959 | Williams | 209/138 |
| 3,312,343 | 4/1967 | Elder et al. | 209/139.1 |
| 3,904,515 | 9/1975 | MacKenzie et al. | 209/138 X |
| 4,931,173 | 6/1990 | Lesher | 209/138 |
| 5,032,256 | 7/1991 | Vickery | 209/146 X |

FOREIGN PATENT DOCUMENTS

| | | | |
|---|---|---|---|
| 0237641 | 8/1990 | European Pat. Off. . | |
| 371504 | 3/1923 | Germany . | |
| 3024853 | 1/1981 | Germany . | |
| 2929672 | 1/1981 | Germany . | |
| 3425101 | 1/1986 | Germany . | |
| 138696 | 1/1953 | Sweden | 209/138 |
| 822927 | 4/1981 | U.S.S.R. | 209/139.1 |

*Primary Examiner*—William E. Terrell
*Assistant Examiner*—Tuan N. Nguyen
*Attorney, Agent, or Firm*—Martin A. Farber

[57] ABSTRACT

A device for cleaning a mixture of substantially granular grains containing differently sized particles comprises a housing (5) which has an inlet (11) for the mixture (1) on its upper side and an outlet (12) for the cleaned granules (18) on its lower side as well as a distributing plate (6). Cleaning gas flows through the granules falling down through the device against the direction of their fall. In the inlet area there is provided a guiding device (19) for the inflowing mixture (1) and a retention unit (2) for the larger particles (3). The distributing plate (6) is provided with a covering hood (16) having a recess (17) for the inflowing mixture. Between the distributing plate (6) and the covering hood (16) there is provided a slot (8), which preferably has a height of about 8 to 15 mm.

38 Claims, 5 Drawing Sheets

DEVICE FOR CLEANING A MIXTURE OF SUBSTANTIALLY GRANULAR GRAINS AND METHOD FOR CLEANING THIS MIXTURE OF GRAINS

FIELD OF THE INVENTION

The invention refers to a device for cleaning a mixture of substantially granular grains containing differently sized particles comprising a housing which has an inlet for the mixture on its upper side and an outlet for the cleaned granules on its lower side, with at least one inlet opening and at least one outlet opening for providing a flow of cleaning gas against the moving direction of the granules falling down through the device, and a distributing plate arranged below the inlet. The invention also refers to a method for cleaning this mixture of grains, wherein the mixture is supplied into a housing via an inlet arranged on its upper side, where—on its path substantially determined by gravitaton—it is flown through by a cleaning gas against its moving direction toward an outlet for the cleaned granules located on the lower side of the housing and where, due to its impingement on a distributing plate arranged below the inlet, it is subjected to a radial acceleration.

BACKGROUND OF THE INVENTION

Due to the great variety of possibilities of development in the course of different processes, such as grinding, crystallizing, condensing—to mention only a few of them—particle masses have correspondingly different size distribution characteristics. Thus, particles will be present in different granular sizes after passing grinding installations, whereas, for example, plastic materials, such as polyethylene terephthalate or polyvinylchlorid after crystallization or polymerization will be present in the form of granules, charged with abrasion or dust particles. The size of such granular particles varies from about 3 to about 5 mm in diameter, and from about 2 to about 5 mm in length. Polyamide granules can even be larger than that. However, in contrast to this, the fine dust particles are maximally sized up to 50 micrometers. Larger particles, sometimes also called "angel's hair"or "birds', nests", may occur in the shapes of disks, balls or spheres and may have a diameter of about 2 cm to about 10 cm. They will develop particularly in connection with pneumatic conveying. Granular material transported by conveying pipes, slides along the pipe with friction, it heats up, forms adhering fibers or foils, which keep on tearing off or coming off. The length of such fibers or small hairs is extremely different; each of them may be only fractions of a millimeter long, however, due to positive connection it may be connected to one-meter-long formed bodies or balls. If, in the case of particle mixtures obtained from grinding plants, particular importance is attached to a classification with great separating efficiency, this will not be of importance in the second case, in which one intends to separate the granules both from substantially smaller dust particles and from substantially larger ones.

By means of known air classifiers, such as they have been described in the DE-A1-34 25 101, the DE-A1-30 24 853 or the U.S. Pat. No. 2,913,109, it is possible to separate heavier particles from lighter ones with great separating efficiency. This is accomplished by having the air classification stream flow in a vortex-shaped manner in the separating chamber and/or by dividing it into a plurality of partial flows of the same volume. To improve the separating effect there are provided distributing plates with blades; the heavier particles are thrown outwardly, the lighter ones are carried along by a centripetal air flow. The EP-B1-237 641 shows a combination, wherein the brittle grinding material from a roller mill is first comminuted on a feed plate with attached impact elements, so that the share of fines obtained is laid bare and is removed during the following classification.

Such classifiers are designed to separate fines from coarse shares; however, a simultaneous separation of fine and substantially larger particles to obtain granules thus cleaned is not possible with this procedure. It is true that a separation into several grain size fractions is possible with the help of multi-component sifters, even with a great separating efficiency, but this will entail considerable constructional expenses.

SUMMARY OF THE INVENTION

In contrast to this, it is the object of the invention to provide a device and a method whereby in the course of the same classifying procedure both fine shares and coarse ones can be separated from a mixture of substantially granular grains, so that the granules will be present in a form free of these shares. This is accomplished by providing a guiding device for the inflowing mixture in the inlet area and a retention unit for the larger particles or subjecting the mixture to a precleaning action in which larger particles are retained by a retaining device whereas the mixture charged with smaller particles is guided so as to pass the retaining device.

By providing a retention unit in the inlet area for the mixture of substantially granular grains compounded with the differently sized particles for those particles that are substantially larger than the granules, there takes place precleaning of the mixture even before feeding it onto the distributing plate where the mixture of grains is then only charged with particles of a smaller size. A guiding unit for the incoming mixture ensures that it will pass through the retention unit.

The already precleaned mixture charged with particles of a smaller size then reaches the distributing plate in the gravitational flow, which distributing plate is preferably provided with a hood that is particularly designed conical, having a recess for the mixture flowing onto the distributing plate. Such a hood prevents the mixture that rebounds from the distributing plate, if necessary, from leaving again against the direction of fall. On the respective circumferential edge between hood and granules there is provided a slot whose largeness depends on the typical granular diameter of the the mixture of grains to be cleaned. Thus, a slot height of 8 to 15 mm will be of advantage for polyester or polyamide granules. The distributing plate itself is designed accordingly, that is to say, preferably in the shape of a cone on top of a truncated cone having a smaller amount of taper against the horizontal plane than the taper of the truncated cone, so that the rebounding grains will remain within the area defined by the hood and can merely pass out of the slot between distributing plate and hood. Such an effect could also be achieved by designing merely the distributing plate in the shape of a cone, yet a design in the shape of a cone on top of a truncated cone is to be preferred since thus the problem zone created by the recess in the hood can be better controlled.

To achieve a uniform veil of thrown particles which is as horizontal as possible and which will thus be flown through by the rising cleaning gas in an extremely effective way and cleaned from smaller particles, the marginal area of the distributing plate is preferably designed horizontal and annular-shaped.

Since the mixture charged with the smaller particles contains these particles also as adhering to the granules, it is advantageous to throw the mixture leaving the distributing plate as a homogenous veil of thrown particles against an impact unit circumferentially enclosing the distributing plate on a larger radius, with the particles adhering to the granules being struck off in this procedure. The inlet opening for the cleaning gas is preferably provided immediately below the impact unit, which represents an advantageous measure regarding the design, the inlet opening being particularly designed in the form of an annular duct, thus enabling a uniform throughput beyond the circumference of the device. However, a central inlet channel for the cleaning gas, supplying the gas from below, would also be conceivable, but this would considerably extend the overall height of such a cleaning device.

To ensure that the mixture of grains flowing in from the inlet reaches the distributing plate through the recess in the hood after passing the retention unit, there is provided a funnel above the distributing plate, which funnel may have a wall raised just on one side, if required, so that the inflowing mixture will be safely received. This funnel may be fastened on one side to the interior wall of the housing, which arrangement has been chosen not just for mere fastening purposes but particularly because it offers the possibility to divide the cleaning gas flowing upwards into at least two partial flows, if necessary. Thus, it will be possible to achieve both a turbulent and an almost laminar (hereinafter called "smoothed") flow behavior. Guiding plates provided on the interior wall of the housing serve to calm down the cleaning gas flowing upwards in the zone above the distributing plate and below the retention unit. If the guiding plates are arranged on one side only, it is possible to smooth merely a partial flow of the cleaning gas in a concerted manner. If necessary, this partial flow can be directed in such a manner that it will flow through the retention unit and thereby carry along the larger particles retained by the latter due to the relatively marked flow resistance of these particles in comparison with the granules. Particles of larger sizes separated by the retention unit will also be carried along by the calmed flow, whereas the granular mixture will not be substantially hampered in its fall.

In order to avoid that the gravitational flow of the granules onto the distributing plate might be hampered and that the granules might thus not be swirled or carried along, the area above the distributing plate is designed such that the velocity of flow of the cleaning gas flowing upwards will be reduced. The cross section flown through by the cleaning gas in this area is increased.

The retention unit is preferably composed of vertical walls parallel to each other, so that the larger particles, which are present as "angel's hair" or "birds's nests", by way of example, will adhere to its upper edges, while the mixture of grains containing the smaller-sized particles can fall down between these walls. This retention unit, which is also called "fiber comb", preferably has its upper edges arranged oblique to a vertical axis, so that retained particles lying on the upper edges can slide into the flow of cleaning gas and be carried along.

The guiding unit for the mixture flowing into the housing of the device, which guiding unit is to prevent the granules from missing the retention unit, may be designed in the form of pivotable flaps reaching with their free sides the upper side of the retention unit, so that larger particles that have been retained are allowed to slide away under these flaps. Alternatively, or in addition to the flap arrangement described, if required, the guiding unit may comprise a dosing device operable in dependence upon the amount of the product flowing into the housing, for example, from a storage vessel, which dosing device is arranged on the storage vessel.

Due to the rotation of the distributing plate the cleaning gas flowing upwards will also be made to rotate. The differential speed between gas flow and granules will thereby be lowered. Therefore, an arrangement may prove to be advantageous wherein the gas flowing into the housing is imparted a spin going against the direction of rotation of the distributing plate. For this purpose, guide blades may be preferably arranged in the inlet opening for the gas, which is particularly designed as an annular channel. These guide blades are preferably designed adjustable, in particular in dependence upon the number of revolutions of the distributing plate, so that the requirements of differing product—or process-determined conditions can be met.

BRIEF DESCRIPTION OF THE DRAWINGS

In the following, the invention will be explained in more detail with reference to the drawings, wherein.

DETAILED DESCRIPTION OF THE DRAWINGS

Figure 1:
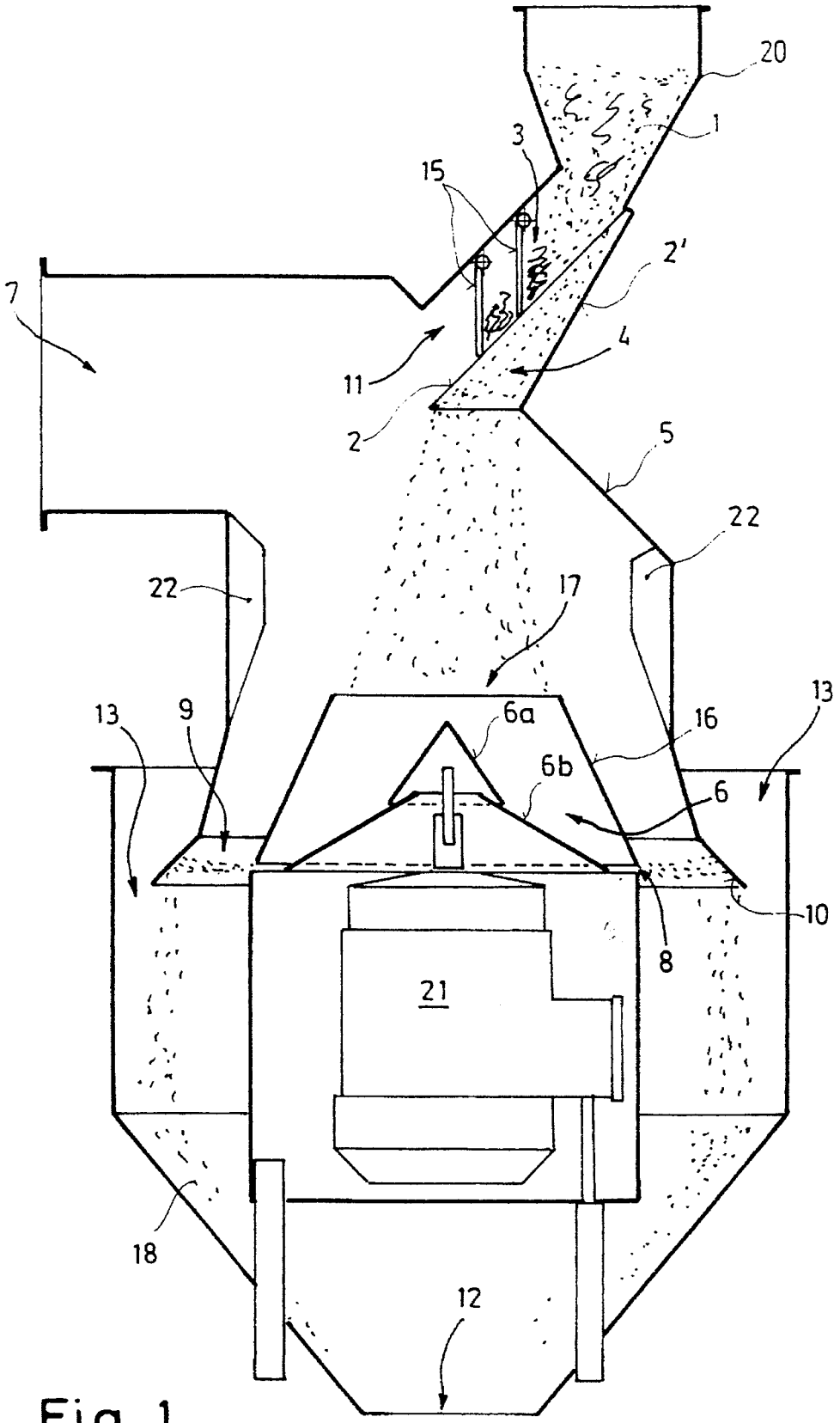
FIG. 1 shows a longitudinal section of a device provided by the invention.

From FIG. 1 a device according to the invention can be seen for cleaning a mixture 1 of substantially granular grains containing differently sized particles. In the following, this device will be called a granular purifier. This granular purifier comprises a housing 5 having an inlet 11 for the mixture 1 of grains containing coarse and fine impurities. At the lower end of the housing 5, there is provided an outlet 12 for the granules 18 that have been cleaned from their impurities. Cleaning gas enters the housing 5 through an inlet opening 13, flows upwards against the mixture of grains moving within a gravitational flow through the housing, whereafter it leaves the housing through the outlet opening 7. The mixture 1 of grains charged with impurities in the form of coarse particles and fine ones enters the housing 5—if required—from a charging vessel 20, and then passes a retention unit 2 made up of a plurality of vertical walls running parallel to each other on a chute delivery 2'. The distance of the walls from each other depends upon the size of the granules; in the case of a granular purifier designed for polyester or polyamide granules, this distance amounts to about 15 mm. Such a retention unit is also called "fiber comb". Larger particles 3, which have accrued in the form of "angel's hair" or "birds' nests", will thereby adhere to the upper edges of the fiber comb 2, whereas the granules 4 compounded with fine particles in dust form are allowed to fall through this comb 2 between the walls. On the interior wall of the inlet area of the housing 5, flaps 15 are pivotally attached, which, with their free sides, lie on the upper edges of the fiber comb 2. Inflowing granules will thereby be prevented from jumping over impurities lying on the upper edges of the fiber comb 2, so that they are to pass through the fiber comb 2. Due to impurities pushing along, the coarse impurities 3 are gradually pushed through below the pivotable flaps 15, caught by the cleaning gas taking along the fine impurities, carried along due to the great flow resistance compared to that of the granules and discharged.

The granules 4 charged with the fine particles fall through the fiber comb 2 onto the distributing plate 6, that is to say, through a recess 17 in a covering hood 16 seated on the distributing plate 6. The distributing plate 6 and the hood 16 are spaced from each other via small connection pieces (not shown) such that a slot 8 of about 15 mm remains spared through which the granules are allowed to flow out. This slot width, however, is not critical.

The distributing plate is rotated by means of a motor 21, on whose shaft it is directly mounted, and so is the the covering hood 16 connected thereto. As will be explained later on, the circumferential speed of this distributing plate amounts to approximately 6 to 16 m/s, preferably 8 to 14 m/s, referred to the medium diameter of the distributing gap 8. In order to prevent granules falling onto the distributing plate 6 from leaping back, the distributing plate 6 and the covering hood 16 are substantially shaped as double cones, so that the granules are always thrown back toward the slot 8. For this purpose, the distributing plate 6 is preferably designed in the form of a truncated cone **6*b* lying on a horizontal ring 6*c*, which truncated cone 6*b* carries a cone 6*a*. The tapering angle of the cone 6*a* against the horizontal plane is greater than that of the truncated cone 6*b***.

The granules are thrown against an impact ring 10 in the form of a homogenous veil of thrown particles 9; adhering, dust-shaped impurities are thereby knocked off and the granules are thrown back against the outlet opening 12. The impact ring 10 is shaped as a truncated cone; this feature and the appropriate selection of the rotational speed of the distributing plate 6 prevents the granules from being destroyed, as, for example, it would be the case with distributing plates provided with impact elements (e.g. in accordance with an arrangement as described in the EP-B1-237 641, which serves to break agglomerates).

The cleaning gas enters the housing through the inlet opening 13 shaped as an annular channel immediately below the impact ring 10, flows through the granules that have been thrown back by the impact ring 10 and through the veil of thrown particles 9, with the cleaning gas carrying along the knocked-off share of fine material, residues of fine particles and other dust-shaped impurities which might still be carried along. The cleaning gas then flows upwards in the area between the covering hood 16 and the interior wall of the housing, with the cross section of this area increasing in upward direction and the flow rate decreasing. Due to the rotation of the distributing plate 6 and the covering hood 16 the cleaning gas is also imparted a spin. Guiding plates 22 arranged on the interior wall of the housing above the distributing plate 6 may serve to calm down the upward streaming gas flow which, in this area, takes along fibers that may have fallen through the fiber comb 2 together with the dust-chaged granules, as well as larger impurities retained by the fiber comb 2. Carrying along with it these coarse impurities and fines the cleaning gas leaves the housing 5 through the outlet opening 7.

Figure 2:
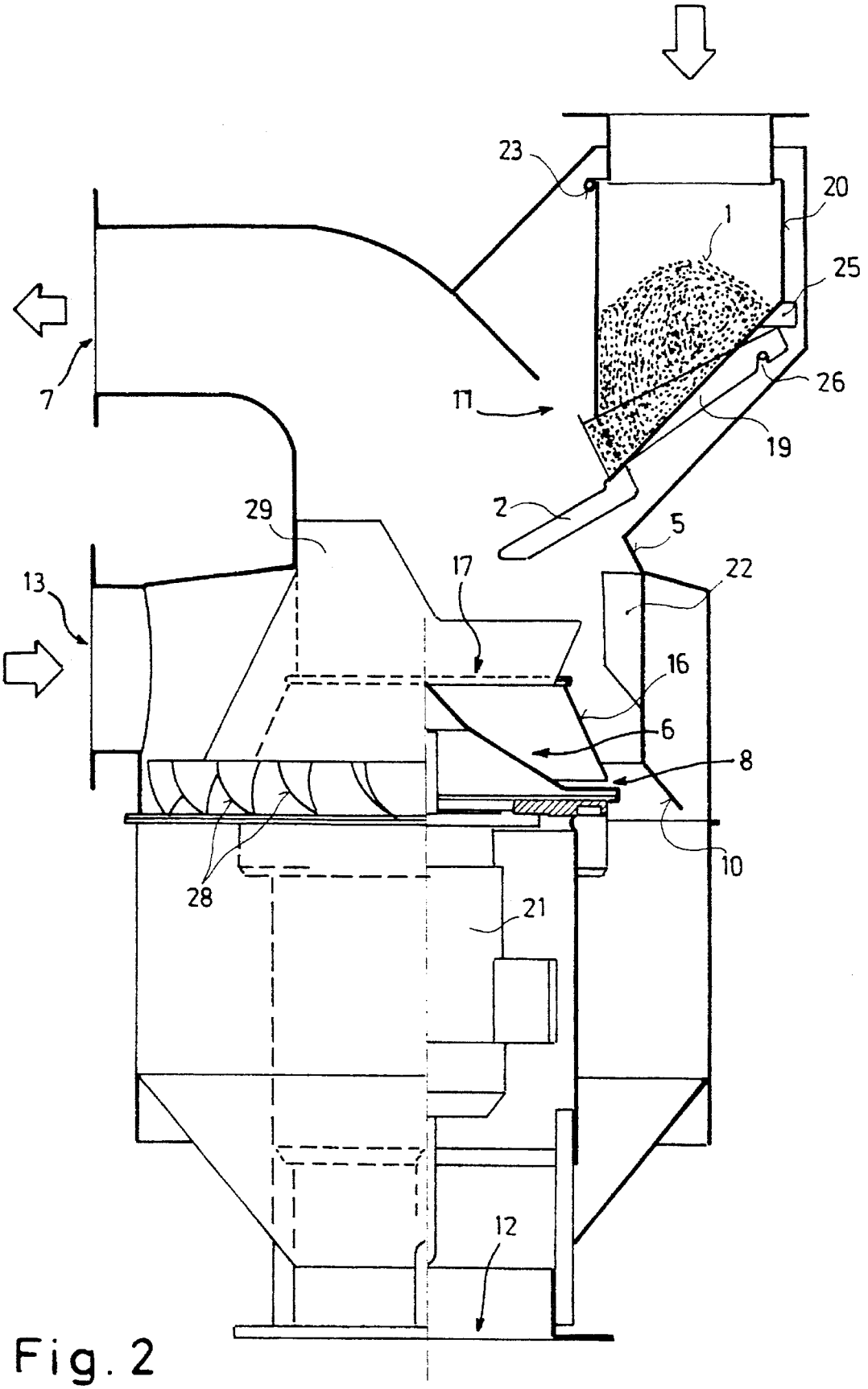
FIG. 2 illustrates a partial longitudinal section and a partial view, with the housing wall of an alternative embodiment being removed.

FIG. 2 shows an arrangement as a modification to the one illustrated in FIG. 1, wherein both the guidance of the mixture of grains and of the gas flow has been optimized. In the right section of FIG. 2 there is illustrated a central longitudinal section of the granular purifier whereas the left section of FIG. 2 shows an elevation of the granular purifier after removal of the exterior wall of the housing. The contaminated mixture 1 of grains is fed into the housing 5 from a charging vessel 20. This charging vessel 20 is rotatably mounted about an axis 23. With increasing filling of the charging vessel 20, a sliding shutter **19*a* supported at 26 is opened wider and wider via a cutting edge 25. Thereby, it will be ensured that the fiber comb 2** is always charged from a bulk in order to prevent the granules from jumping over the fiber comb.

The dust-compounded granules pass through the fiber comb 2; a collection funnel 29 attached to the interior wall of the housing 5, which collection funnel 29 is designed somewhat raised on one side, causes the granules to safely reach the distributing plate 6 through the recess 17 of the covering hood 16. The veil of particles 9 thrown off the distributing plate 6 (FIG. 1) impinges upon the impact ring 10, with the dust adhering to the granules being knocked off and carried along by the cleaning gas. The cleaning gas enters the housing 5 through the annular channel 13, and via the guiding blades 28 impart a spin opposing the direction of rotation of the distributing plate 6. The gas flows through the veil of thrown particles and the granules thrown back toward the outlet opening 12, as described above, thereby carrying along with it knocked-off dust that has been carried by the granules. Since the collection funnel 29 is fixed to the interior wall of the housing 5 on its raised side, the gas flow, after streaming along the upper side of the covering hood 16, will stream upwards at this place on both sides of the funnel 29 The gas flow smoothed by the guiding plates 22 will pass the fiber comb 2 projecting into the housing 5 and carries the larger particles, such as "angel's hair" and "birds' nests", along with it. Since the collection funnel 29 is connected to the interior wall of the housing, it is possible to direct the gas flows streaming upwards on its sides such that they will no longer pass through the fiber comb 2, so that merely that partial flow streaming upwards on the free side of the collection funnel 29 in a flow calmed down by the guiding plates 22, will pass through the fiber comb 2. It has turned out to be advantageous to direct only one partial flow of the cleaning gas through the fiber comb 2, so that solely the coarse impurities are carried along in a carefully selected manner. It is conceivable to render the intensity of this gas flow adjustable by means of pivoting guiding plates on the interior wall of the housing and/or on the outer sides of the collection funnel 29 and/or on the covering hood 16, in dependence upon the degree of contamination of the mixture or upon the granular sizes or upon the flow rate of the cleaning gas.

The guiding blades 28 should preferably be designed adjustable so that—in dependence upon the rotational speed of the distributing plate 6 and, if necessary, upon the flow rate of the gas—the gas can be imparted such a spin that the differential speed between gas and granules is optimized.

Figure 3:
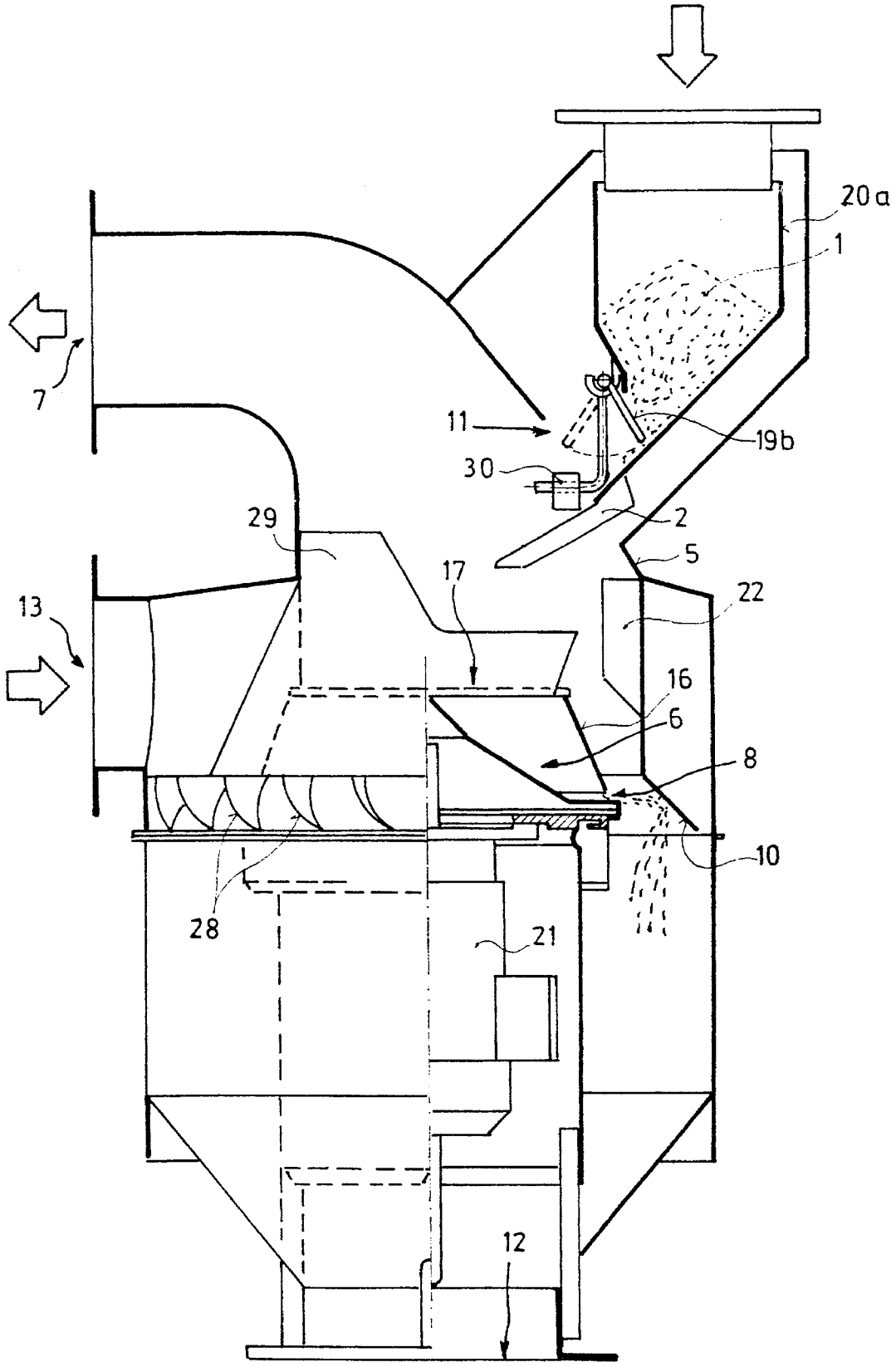
FIG. 3 represents a device that corresponds to FIG. 2 with a modified inlet dosing device; and the FIGS. 4 and 5 show each a further embodiment.

FIG. 3 shows an embodiment of the granular purifier which corresponds to FIG. 2. The mixture 1 flowing from the charging vessel **20*a*, arranged stationary in this particular case, is led through the dosing device designed as swinging flap 19*b*. The greater the filling of the charging vessel 20*a*, the wider the swinging flap 19*b* opens, which can be reset via a weight 30. In this way it will be ensured that in accordance with the arrangement represented in FIG. 2 the fiber comb 2** is always charged from a bulk.

It is to be understood that the fiber coma 2 described is of advantage independently of the way the cleaning device lying below it looks like. However, it must be mentioned that the required sloping position of the delivery chute supporting the walls 2 may not always be advantageous for charging the centrifugal or distributing plate 6 since the granules 4 falling down may impinge thereon more or less remote from the center and the axis of revolution, which will impart different accelerations to the granules 4.

Figure 4:
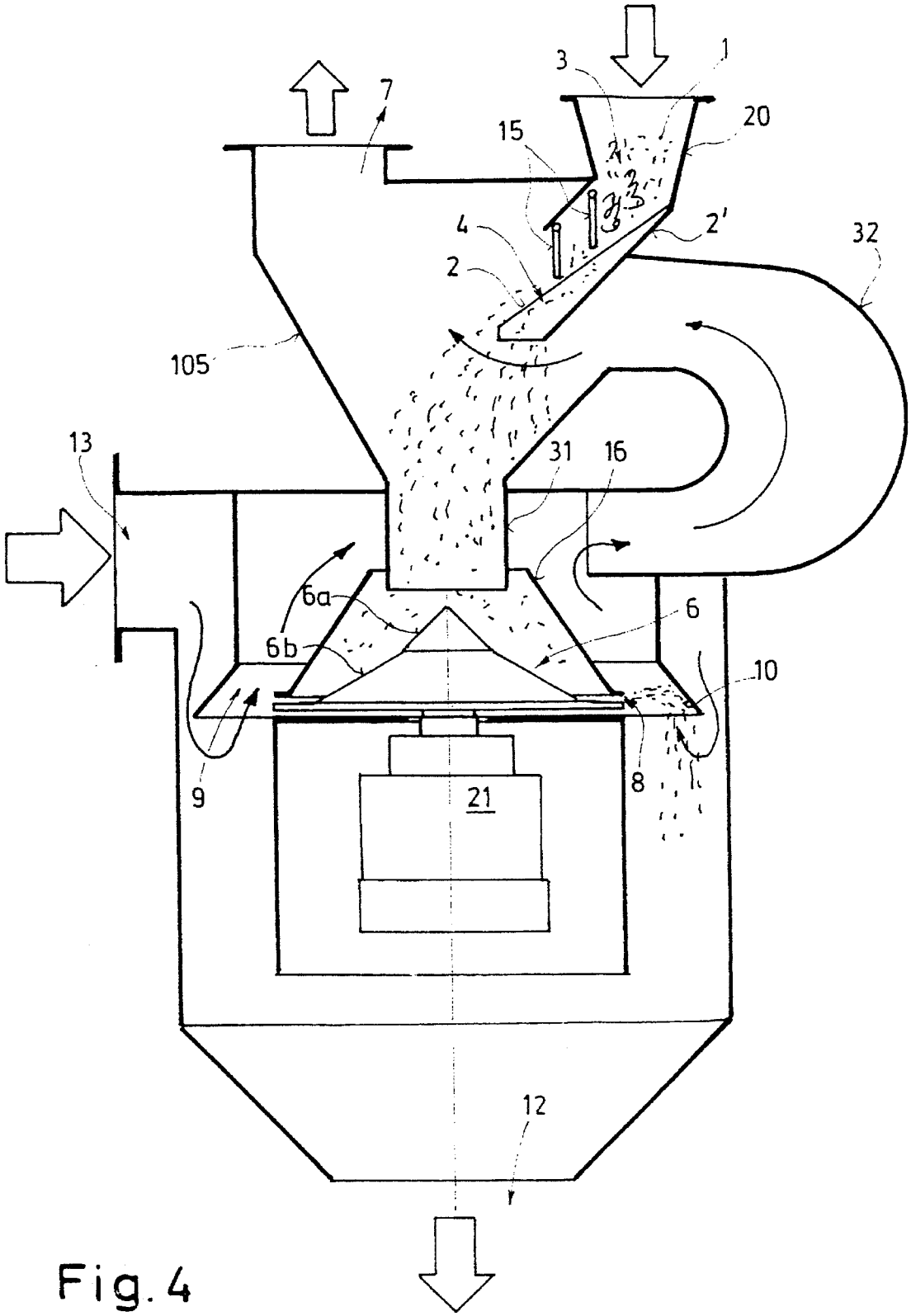

Therefore, it is possible—as shown in FIG. 4—to arrange, above the distributing plate 6, a vertical conduit 31 pointing to the rotational axis of the distributing plate 6 from a chamber 105, with the sloped delivery chute 2' joining the upper side of the chamber 105 with its vertical fiber comb walls 2. Thus, the chamber 105 substantially corresponds to the space designated 5 in FIG. 5.

The air can now flow either parallely into the space enclosing the distributing plate 6 on the one hand, and, on the other hand, into the chamber 105 closed in the above-mentioned manner, comprising the fiber comb. Preferably, however, it flows through both spaces in a way apparent from FIG. 4. For this purpose, there is provided a delivery tube 32 receiving the air flowing in via the air paths 9 and 13, which air is charged with dust at 10, leading it to the chamber 105, preferably within the area of the delivery chute 2'. When using such an arrangement, the delivery chute 2' may be designed forked at its free end, if necessary, so that the prongs of this fork are formed by the vertical walls 2 and in order that the bottom lying therebetween recedes somewhat, which will enable air to flow through from below between the vertical walls 2 and to tear away in upward direction any fibers adhering to the upper side of the walls 2, whereupon the air thus charged (or an inert gas) will flow out again at 7.

Figure 5:
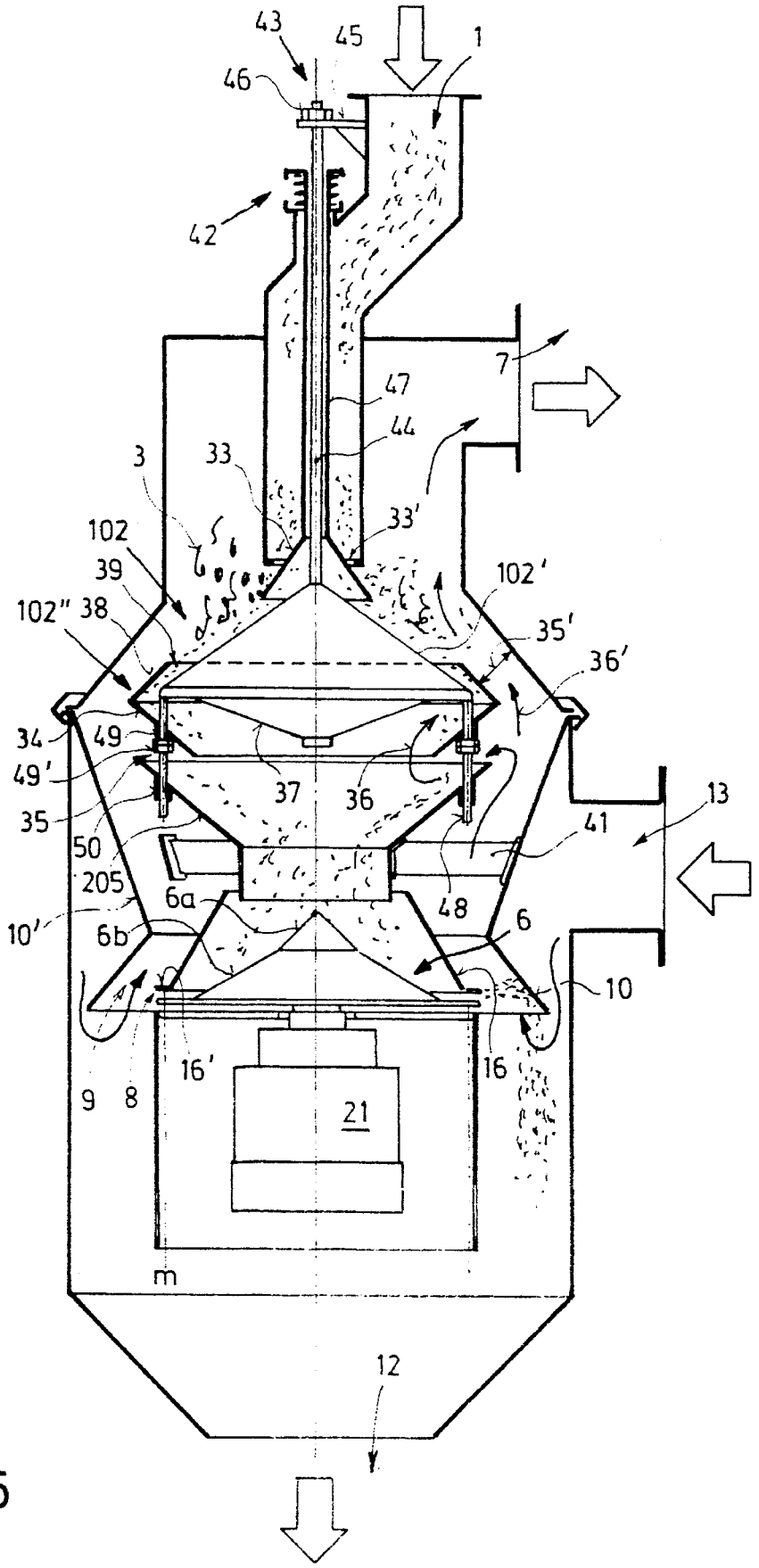

While in the previous embodiments the retention unit 2 carrying out a pre-separation is designed as a sort of fiber comb, FIG. 5 shows a retention unit 102 which, in principle, can also be used for a pre-separation of fine particles, thus being employable in a more universal way. In this arrangement, there is preferably provided a feed hopper 205 with a vertical axis, coaxially arranged with respect to the rotational axis of the stributing plate 6, which feed hopper 205 is held stationary within the shell 10' by means of a tripod support 41. Above this feed hopper 205, there is a construction with a guiding cone 102' which, together with a conical metering valve 33 and a valve seat 33', is designed similar to the way shown in the DE-A-29 29 672. However, the guiding cone 102' forms a pneumatic retention device 102 in conjunction with an air-guiding ring 102".

For this purpose, the bottom section of the air-guiding ring 102" joins the collection funnel 205 with a lower surface 34 here exhibiting a tapering shape, having a slot 35, which is adjustable, if required, in order to cause a transmission of a partial flow 36 of the air supplied via the inlet 13, and flowing in via the slot 35. Of course, also other constructions, such as nozzles or the like, distributed over the circumference of the surface 34, which are adjustable, if necessary, can be provided for supplying this partial flow 36 streaming through the retention unit 102.

The cross-sectional ratio of the slots 35, 35' now serves to ensure a relatively uniform and flow-stable branching of the air flow 36 from the remaining air flow 36'. Moreover, it is to be understood that the lower surface 34 does not necessarily have to be shaped funnel-like, but that it may also be conical or cylindrical. However, if the guiding cone 102' is provided with a counter-cone 37 also at its bottom section, an air-guiding channel will form in an advantageous way together with the surface 34 favoring a uniform distribution of the air flow between these two surfaces, with the air having entered the relatively broad feed hopper 205 from the slot 35 accelerating once again for the moment and being distributed in a uniform way over the circumference before it reaches the upper surface 38 preferably running substantially parallel to the guiding cone 102' and is deviated by it in such a way that it passes over the surface of the guiding cone 102'.

In this arrangement, the guiding cone 102 has a function which has no model in the state of the art. For, on the one hand, the conical surface necessarily involves the stream of material flowing down from the radial interior side over the valve 33, 3' getting thinner and thinner due to the conical surface enlarging in radially outward direction until there merely remains a veil of material formed by individual grains in the edge region. On the other hand, the guiding cone 102'—together with the surface 38—defines a conveniently adjustable slot 39, which can be designed or adjusted such that larger balls of fiber-shaped material will be held up. The partial flow 36 blows over the edge region of the guiding cone through the slot nozzle 39 formed by the surface 38 in conjunction with the guiding cone 102', on which edge region the veil of material will be thinner, therefore releasing any present fibers, so that such fibers 3 can easily be carried along. The valve seat 33 is adjustable or self-adjusting relative to its seat 33', as it has become known from the DE-C-29 29 672, the entire contents of which are incorporated herein by reference, so that a detailed description of the appertaining adjustment mechanism may be omitted.

The height of the guiding cone 102' may be set relative to the air-guiding ring 102" for the purpose of adjusting the slot 39 by means of an adjustment device 49. Changing the flow cross section of the slot 35 and 35' is made possible from the outside by raising or lowering the assembly comprising the guiding cone 102' and the guiding ring 102". Similar to the adjustment device 42, there is provided a holding bar 44 carrying a screw nut 46 supported at its upper end by a stationary limit stop 45.

To accommodate the two adjustment devices 42, 43 in a very limited space, one of the holding bars, here the bar 47 of the adjustment device 42 for the valve 33, 33', is hollow and comprises the respective other bar 44. A further guidance for the guiding cone 102' is provided on its lower side, where a plurality of conveniently three holding bars 48 protrude vertically in downward direction and are guided in guide bushes 50 of the stationary funnel 205. In this way, there will be ensured a uniform slot width and, along with it, a uniform air distribution over the entire circumference of the guiding cone 102' as well as an adjustable subdivision of the air flow into partial flows 36, 36'.

On the basis of FIG. 5 there will be described an advantageous dimensioning, which can be employed in an analogous way for the remainder of the embodiments. For drawing a circle of a marginal area around the distributing plate 6 will result in a maximum speed of the particles in this area. In the embodiments according to FIGS. 4 and 5 the particles are guided in this marginal area through a flange 16' extending radially outwardly. In the medium area of the slot 8 thereby created there is drawn a line m represented in dot-dashed lines, and it has proved to be favorable to dimension the motor 21, or a gear unit arranged between the motor 21 and the distributing plate 6 such that an average particle speed of 6 to 16 m/s, preferably 8 to 14 m/s will result in the marginal area of the distributing plate 6, and particularly in the medium area m of the slot 8.

Within the scope of the invention, numerous modifications are conceivable; e.g. the retention unit 2 or 102 can also be implemented without a rotating distributing plate without losing any of its advantages.

What is claimed is:

1. A sifter for cleaning granulate bulk material of differently sized particles comprising:

a housing with an upper end and a lower end including at least one material inlet opening through which said bulk material enters said housing, said material inlet opening being located at said upper end;

at least one granulate outlet opening through which cleaned granulate bulk material leaves said housing, said granulate outlet opening being located at said lower end;

at least one gas inlet opening through which a cleaning gas flows into said housing;

at least one gas outlet opening through which said cleaning gas carries unwanted particles out of said housing;

a distributing plate rotatably mounted in said housing below said material inlet opening for directing bulk material into a path of said cleaning gas;

guiding means at said material inlet opening for guiding said bulk material into said housing; and retention means located at said guiding means for retaining oversized particles;

wherein said retention means comprises a filter comb oriented in a downward direction along a path of travel of said bulk material for extraction of hair-like matter from said bulk material; and said gas inlet and said gas outlet openings are arranged for directing the gas to flow at least in part against said bulk material falling through said housing and against said filter comb for removal of a portion of said hair-like matter falling along a surface of said filter comb.

2. Sifter as claimed in claim 1, wherein said distributing plate includes a hood mounted on the upper side of said distributing plate, wherein said hood has a hood opening at its upper end arranged in such a way that said bulk material falling from said material inlet opening gets to said distributing plate, and is mounted at a distance of 3 mm to 50 mm above said distributing plate and therefore creates a gap in between said hood and said distributing plate for passing of said bulk material.

3. Sifter as claimed in claim 2, wherein said hood has the shape of an envelope of a truncated cone.

4. Sifter as claimed in claim 2, wherein said distance is in the range of 8 mm to 15 mm.

5. Sifter as claimed in claim 1, wherein said distributing plate includes:

a lower distributing part in the form of a truncated cone; and an upper distributing part in the form of a cone mounted on top of said lower distributing part and having a smaller amount of taper than said lower distributing part.

6. Sifter according to claim 1, wherein in said retention means, said passage includes at least one slot between at least one pair of corresponding walls and with gas flowing through said at least one slot against said bulk material passing through said at least one slot.

7. Sifter as claimed in claim 6, wherein at least the walls of one pair of said corresponding walls are parallel.

8. Sifter as claimed in claim 7, wherein at least the walls of one pair of said corresponding walls are arranged vertically and have upper end edges oblique to a vertical axis.

9. Sifter as claimed in claim 6, wherein at least the walls of one pair of said corresponding walls are arranged upwards oblique to a vertical axis.

10. Sifter as claimed in claim 9, wherein one wall of at least one pair of said corresponding walls is built by a cone having said first conic surface, wherein said bulk material falls onto the center of said cone.

11. Sifter as claimed in claim 1, wherein said guiding means further comprises at least one flap on a first side slewably connected to said guiding means and with a free side opposite to said first side reaching an upper side of said retention means.

12. Sifter as claimed in claim 1, wherein said guiding means further comprises a dosing device which is controllable by the amount of inflowing bulk material.

13. Sifter as claimed in claim 1, further comprising impact means arranged on the inner side of said housing ringshaped around said distributing plate.

14. Sifter as claimed in claim 13, wherein said impact means is located immediately above said gas inlet opening.

15. Sifter as claimed in claim 1, wherein said housing encloses a gas passageway with increasing cross section from said gas inlet opening to said gas outlet opening.

16. Sifter as claimed in claim 15, wherein said increasing cross section is located above said distributing plate.

17. Sifter as claimed in claim 1, further comprising guide blades located at said gas inlet opening for inducing a gas rotation with a sense of rotation opposite to the rotation of said distributing plate.

18. Sifter as claimed in claim 17, wherein said gas inlet opening is a ring channel.

19. Sifter as claimed in claim 17, wherein said guide blades have adjustable orientations.

20. Sifter as claimed in claim 19, wherein said orientation of said guide blades depends on the speed of rotation of said distributing plate.

21. Sifter as claimed in claim 1, wherein said distributing plate rotates with a speed causing particle velocities at the radial outer end of said plate of 6 m/s to 16 m/s.

22. Sifter as claimed in claim 21, wherein said particle velocities are in the range of 8 m/s to 14 m/s.

23. Sifter as claimed in claim 1, further comprising funnel means located above said distributing plate.

24. Sifter as claimed in claim 23, wherein said funnel means is fixed to said housing only partially on its circumference.

25. Sifter as claimed in claim 23, wherein said funnel means has a wall extending higher up on a side remote from said material inlet opening.

26. Sifter as claimed in claim 1, further comprising a compartment of said housing located above said distributing plate;

a delivery chute tilted downward towards an outlet end of said chute, wherein said outlet end is located within said compartment; and a vertical shaft connected to said compartment and located centrally above said distributing plate.

27. Sifter as claimed in claim 26, wherein said delivery chute has vertical walls.

28. Sifter as claimed in claim 26, further comprising a passage arranged in parallel to said vertical shaft for guiding gas from an area around said distributing plate to said compartment.

29. A sifter for cleaning granulate bulk material of differently sized particles comprising:

a housing with an upper end and a lower end including at least one material inlet opening through which said bulk material enters said housing, said material inlet opening being located at said upper end;

at least one granulate outlet opening through which cleaned granulate bulk material leaves said housing, said granulate outlet opening being located at said lower end;

at least one gas inlet opening through which a cleaning gas flows into said housing;

at least one gas outlet opening through which said cleaning gas carries unwanted particles out of said housing, wherein said gas inlet and said gas outlet openings are arranged in such a way that the gas flows at least in part against said bulk material falling through said housing;

a distributing plate rotatably mounted in said housing below said material inlet opening;

guiding means at said material inlet opening for guiding said bulk material into said housing;

retention means located at said guiding means for retaining oversized particles;

wherein said distributing plate includes:

a lower distributing part in the form of a truncated cone;

an upper distributing part in the form of a cone mounted on top of said lower distributing part and having a smaller amount of taper than said lower distributing part; and a ring extending radially out from lower end of said lower distributing part.

30. A sifter for cleaning granulate bulk material of differently sized particles comprising:

a housing with an upper end and a lower end including at least one material inlet opening through which said bulk material enters said housing, said material inlet opening being located at said upper end;

at least one granulate outlet opening through which cleaned granulate bulk material leaves said housing, said granulate outlet opening being located at said lower end;

at least one gas inlet opening through which a cleaning gas flows into said housing;

at least one gas outlet opening through which said cleaning gas carries unwanted particles out of said housing, wherein said gas inlet and said gas outlet openings are arranged in such a way that the gas flows at least in part against said bulk material falling through said housing;

a distributing plate rotatably mounted in said housing below said material inlet opening;

guiding means at said material inlet opening for guiding said bulk material into said housing;

retention means located at said guiding means for retaining oversized particles; and guiding plates located above said distributing plate and below said retention means on an inner wall of said housing for making at least a part of said gas flow to said gas outlet opening more laminar.

31. Sifter as claimed in claim 30, wherein said guiding plates are mounted asymmetrically and said guided part of the gas flow thus flowing through a part of the cross section of said housing.

32. A method for cleaning granulate bulk material of differently sized particles comprising the steps of:

feeding said bulk material into a housing through at least one material inlet opening at said upper end of said housing;

maintaining a gas flow at least in part flowing against said bulk material which falls down in said housing;

radially accelerating said bulk material with a distributing plate onto which said bulk material falls on its way to a granulate outlet opening at a lower end of said housing;

precleaning said bulk material at an inlet area at said material inlet opening by retaining oversize particles with retention means through which said bulk material passes, said retention means comprising a downwardly directed filter comb; and directing gas of the gas flow against the filter comb to remove hair-like matter sliding down the filter comb.

33. Method as claimed in claim 32, further comprising the step of exposing said radially accelerated bulk material to an impact ring arranged around said distributing plate, said bulk material being reflected at said impact ring towards said granulate outlet opening wherein said reflection causes detaching of unwanted fine particles from said granulate material.

34. Method as claimed in claim 32, wherein said gas flow is set in rotation by guide blades located at a gas inlet opening, said rotation having a sense of rotation opposite to the rotation of said distributing plate.

35. Method as claimed in claim 34, wherein said gas inlet opening is located immediately below said distributing plate and said impact ring.

36. Method as claimed in claim 32, wherein said gas flow consists of at least a first partial gas flow and a second partial gas flow, said first partial gas flow being made less turbulent in an area adjacent to said retention means.

37. Method as claimed in claim 36, wherein said first partial gas flow flows at least partially through said retention means.

38. A method for cleaning granulate bulk material of differently sized particles comprising the steps of:

feeding said bulk material into a housing through at least one material inlet opening at said upper end of said housing;

maintaining a gas flow at least in part flowing against said bulk material which falls down in said housing;

radially accelerating said bulk material with a distributing plate onto which said bulk material falls on its way to a granulate outlet opening at a lower end of said housing;

precleaning said bulk material at an inlet area at said material inlet opening by retaining oversize particles with retention means through which said bulk material passes;

wherein said gas flow consists of at least a first partial gas flow and a second partial gas flow, said first partial gas flow being made less turbulent in an area adjacent to said retention means; and said reduction of turbulence in said first partial gas flow is caused by guiding plates.

* * * * *